United States Patent [19]

Fisher et al.

[11] Patent Number: 4,776,446

[45] Date of Patent: Oct. 11, 1988

[54] HANDRAIL FOR TRANSPORTATION APPARTUS

[75] Inventors: Marvin D. Fisher, Murrysville Boro, Pa.; Louis E. Bobsein, Basking Ridge, N.J.

[73] Assignee: Westinghouse Electric Corp., Pittsburgh, Pa.

[21] Appl. No.: 134,665

[22] Filed: Dec. 18, 1987

[51] Int. Cl.[4] ..... B66B 9/12

[52] U.S. Cl. ..... 198/337

[58] Field of Search ..... 198/335, 337

[56] References Cited

U.S. PATENT DOCUMENTS 3,623,590 11/1971 Johnson ..... 198/337

3,865,225 2/1975 Phal ..... 198/337

*Primary Examiner*—Robert J. Spar

*Assistant Examiner*—D. Glenn Dayoan

*Attorney, Agent, or Firm*—D. R. Lackey

[57] ABSTRACT

A handrail for transportation apparatus, such as escalators and moving walks, which includes an elongated, extruded elastomeric member having first and second wear strips fixed to inner surfaces of the elastomeric member for contacting a handrail guide. Each wear strip has a substantially U-shaped cross-sectional configuration, including a bight and spaced leg portions, and , in addition to providing low friction wear surfaces, the configuration aids the handrail in resisting derailment from a handrail guide. At least one leg portion of each wear strip has a plurality of spaced slots, or thin webs, which extend inwardly from the end of the leg to facilitate flexing of the elastomeric body member while traversing curved portions of a handrail guide. In another embodiment, a plurality of relatively short, discrete wear strips are spaced apart to collectively define an elongated wear strip, with the spacings being selected to function as flexiblity imparting slots.

13 Claims, 4 Drawing Sheets

HANDRAIL FOR TRANSPORTATION APPARTUS

BACKGROUND OF THE INVENTION

1. Field of the Invention:

The invention relates in general to handrails for transportation apparatus, such as escalators and moving walks, and more specifically to handrails which are extruded from an elastomeric material.

2. Description of the Prior Art:

Handrails for transportation apparatus may be built up of several plies of canvas and rubber, and molded into a composite body member, or they may be extruded using a suitable polymeric material. The extrusion process is attractive from an economic viewpoint, as long runs may be made. Desired lengths are simply cut from a longer length. Our U.S. Pat. No. 4,618,387 sets forth methods of splicing the ends of such a handrail into a continuous loop.

Selection of the resulting hardness of the elastomeric material used in the extrusion of handrails is a compromise between lateral stiffness and longitudinal flexibility. The handrail must have sufficient longitudinal flexibility to enable it to follow a handrail guide around the turnarounds at the ends of an escalator or moving walk. On the other hand, it must be sufficiently stiff to provide reliable hand support for passengers on the transportation apparatus, and sufficiently stiff, at least laterally, to resist both accidental and deliberate derailment of the handrail from a handrail guide.

Other factors in the selection of the hardness of the elastomeric material relate to its coefficient of friction, as a series of driven and pressure rollers disposed on opposite sides of the handrail are often used to propel the handrail about a substantially closed guide loop. U.S. Pat. No. 3,712,447 discloses a push-pull closed guide loop arrangement, while suitable handrail drive arrangements are disclosed in U.S. Pat. Nos. 3,414,109 and 3,779,360, all of which are assigned to the same assignee as the present application. Thus, softer and more flexible material is desirable from the viewpoint of the driving function. Softer and more flexible material, however, wears more quickly than higher durometer material, and thus some means must be employed to prevent premature wear of the handrail body material.

Thus, it would be desirable, and it is the object of this invention, to provide an extruded handrail which is: (1) sufficiently flexible to smoothly traverse a handrail guide in the turnarounds of transportation apparatus, without any tendency to kink or otherwise resist such movement, (2) sufficiently stiff to function as a hand support for passengers, (3) sufficiently stiff in lateral stiffness to resist derailment of the handrail from a handrail guide, (4) sufficiently soft to provide the coefficient of friction required for driven and pressure rollers to propel the handrail about a handrail guide without slippage between the driven rollers and the handrail, and (5) sufficiently hard to provide an acceptable rate of wear.

SUMMARY OF THE INVENTION

Briefly, the present invention is a new and improved extruded handrail which has a solid polymeric composition, except for co-extruded, centrally located, substantially inextensible means for stabilizing the length dimension of the handrail during tension and during temperature and humidity changes. The handrail has a substantially C-shaped cross-sectional configuration having an inner surface which defines a handrail guide-receiving configuration. The C-shaped configuration includes a back portion and first and second depending leg portions which terminate in in-turned lip portions. The inner surface includes spaced first and second curved surfaces defined by the depending leg portions and the in-turned lip portions, and a longitudinally continuous, substantially flat drive surface which extends laterally between the spaced first and second curved surfaces.

First and second wear strips, which are constructed of a higher durometer polymeric material than the extruded body of the handrail, and which are also preferably co-extruded into operative position at the time the handrail is extruded, are disposed against, and preferably fixed to, the first and second curved inner surfaces of the handrail, respectively. The first and second wear strips, which may be of like construction, have a substantially U-shaped cross-sectional configuration, including a bight and first and second leg portions. The first leg portion is adjacent to the flat drive surface, and the second leg portion extends approximately to the end of the associated curved inner surface. In a preferred embodiment of the invention, flexibility is imparted to at least the second leg portion of each wear strip by a plurality of spaced slots or notches; or alternatively, by a plurality of spaced sections which have a reduced thickness dimension, i.e., thin webs, compared with the remaining portion of the wear strip. In another embodiment, slots are simulated by providing a plurality of spaced apart, relatively short, discrete wear strips, with the spacings creating the desired flexibility, and thus functioning as slots.

The higher durometer wear strips provide a dual function, i.e., they prevent wear of the body portion of the handrail, and they strengthen the lips of the handrail. Thus, the material of which the body of the handrail is formed may be selected without regard to its wear characteristics, and without regard to the fact that it may be, by itself, too flexible to resist derailment from a handrail guide. The criteria for selecting the handrail material is thus primarily flexibility and coefficient of friction for the driving function, with these selection factors being compatible, and not mutually off-setting or requiring a deleterious compromise.

In like manner, the material of the wear strips may be selected for its ability to resist wear while exhibiting a relatively low coefficient of sliding friction, and for its ability to strengthen the lips of a handrail, to increase the resistance of a handrail against accidental and/or deliberate derailment of the handrail from a handrail guide. Again these selection factors are compatible, both requiring a higher durometer material than the more flexible, higher coefficient of friction material desired for the body of the handrail. While the wear strips strengthen and rigidize the lips of the handrail, the hereinbefore mentioned plurality of spaced sections, such as slots, notches, or thin webs, prevent the wear strips from deleteriously affecting the ability of the handrail to follow a handrail guide about the curved turnarounds of an escalator or moving walk.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF THE PREFERRED EMBODIMENTS

Figure 1:
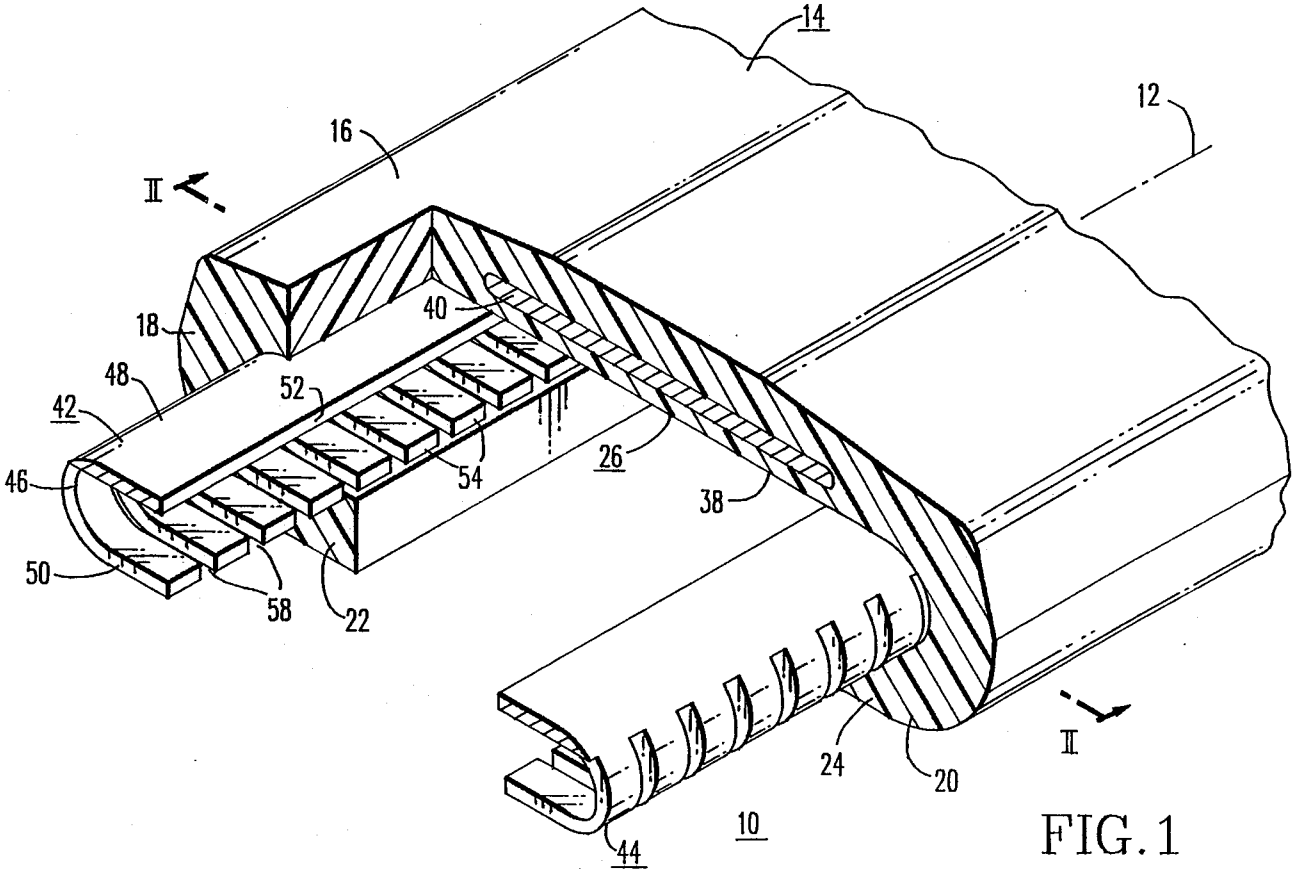
FIG. 1 is a fragmentary perspective view, shown partially cut away, of an extruded handrail having wear strips constructed according to the teachings of the invention.
Figure 2:
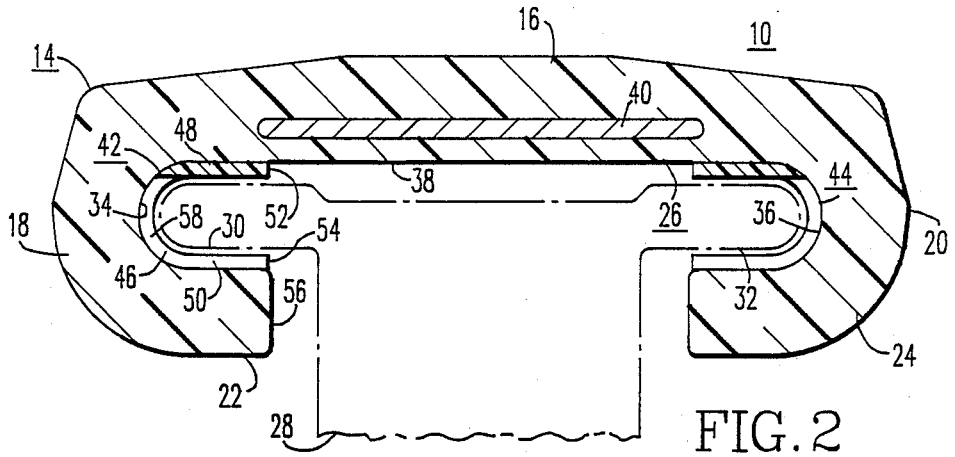
FIG. 2 is a cross-sectional view of the handrail shown in FIG. 1, taken between and in the direction of arrow II—II in FIG. 1.

Referring now to the drawings, and to FIGS. 1 and 2 in particular, there is shown in FIG. 1 a fragmentary perspective view, with parts cut away, of an extruded handrail 10 constructed according to an embodiment of the invention. FIG. 2 is a cross-sectional view of handrail 10, taken between and in the direction of arrows II—II in FIG. 1. Handrail 10, which has a longitudinal axis 12, is suitable for use with escalators and moving walks. Handrail 10 is cut to length from an extruded section of handrail, and the ends are joined together to from a continuous loop. The joining method disclosed in our hereinbefore mentioned U.S. Pat. No. 4,618,387 may be used, for example.

Handrail 10 is extruded from an elastomeric polymeric material, such as a polyurethane, to form a body member 14 having a substantially C-shaped cross-sectional configuration. The C-shaped cross-sectional configuration includes a back portion 16 and first and second depending leg portions 18 and 20 which respectively terminate in in-turned lip portions 22 and 24.

The C-shaped cross section of handrail 10 defines an inner surface 26 which defines a handrail guide receiving configuration, such as the handrail guide 28 shown in phantom in FIG. 2. The cross-sectional configuration of handrail guide 28, is substantially T-shaped, having "ears" 30 and 32 which cooperate with lip portions 22 and 24, respectively, to hold handrail 10 on handrail guide 28. Handrail guide 28 preferably defines a substantially continuous closed loop, such as described in the hereinbefore mentioned U.S. Pat. No. 3,712,447.

Inner surface 26 includes first and second curved surfaces 34 and 36, best shown in FIG. 2, defined by the depending legs 18 and 20 and the in-turned lip portions 22 and 24. Inner surface 26 also includes a longitudinally continuous, substantially flat, drive surface 38 against which driven rollers of a handrail drive may exert pressure to propel handrail 10 about a substantially continuous closed guide loop.

The elastomeric material of body member 14 is extruded about inextensible means 40, metallic or non-metallic, as desired. Inextensible means 40 is centrally located, i.e., bisected by longitudinal axis 12. Inextensible means 40 may be in the form of a metallic strip or band, such as steel, as shown in FIGS. 1 and 2, a plurality of steel cables may be used, as disclosed in our U.S. Pat. No. 4,618,387, or a non-metallic material having a high tensile strength without significant distortion or stretching may be used. Inextensible means 40 reinforces handrail 10, restraining it from elongating or shortening due to tension or compression in handrail 10 as handrail 10 is driven in synchronism with the associated escalator or moving walk. The embedded reinforcement 40 also dimensionally stabilizes handrail 10 during changes in temperature and humidity.

According to the teachings of the invention, first and second elongated wear strips 42 and 44 are disposed in contact with the first and second inner curved surfaces 34 and 36, respectively. While wear strips 42 and 44 are "trapped" in the illustrated operative positions by ears 30 and 32 of handrail guide 28, in a preferred embodiment of the invention wear strips 42 and 44 are fixed to the curved inner surfaces 34 and 36. For example, wear strips 42 and 44 may be glued to inner curved surfaces 34 and 36, respectively, with a suitable adhesive; or, wear strips 42 and 44 may be co-extruded into their operative positions at the same time body member 14 is extruded, with the hot polymeric material of body member 14 bonding tenaciously to wear strips 42 and 44 as the body member 14 cools to ambient.

Figure 2A:
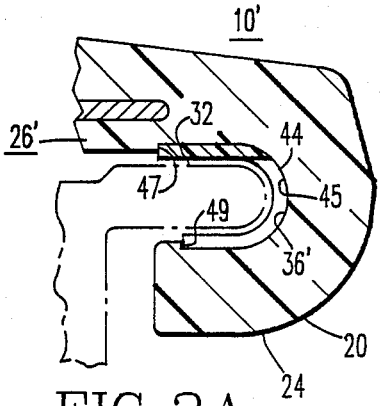
FIG. 2A is a fragmentary view of the handrail shown in FIG. 1, which is similar to FIG. 2, except the inside of the handrail has extruded pockets which aid in holding the wear strips in their operative positions.

FIG. 2A illustrates an embodiment of the invention which is directed to a more positive arrangement for fixing wear strips 42 and 44 in their operative positions relative to the body member 14 of the extruded handrail 10. In this embodiment, inner surface 26' is extruded to form "pockets" into which the wear strips may be snapped, with or without adhesive, such as pocket 45 which defines shoulders 47 and 49 for locating and holding wear strips 44 in its operative position.

The first and second wear strips 42 and 44 may be of like construction, and thus only wear strip 42 will be described in detail. Wear strip 42 is preferably formed of a polymeric material selected for its strength and wear characteristics, and further selected to provide very little drag as it slides along handrail guide 28. For example, wear strip 42 may be formed of polyurethane having a hardness in the range of about 40 to 75 Shore D. Wear strip 42 has a substantially U-shaped cross-sectional configuration, the outer surface of which matches the configuration and dimensions of curved inner surface 34. The U-shaped configuration of wear strip 42 includes a bight 46 and first and second leg portions 48 and 50, respectively. The first leg portion 48 has a longitudinally extending edge 52 at its extreme end which is located adjacent to one side of the flat driving surface 38, and the second leg portion 50 has a longitudinally extending edge 54 which terminates substantially flush with a surface 56 which defines the termination of the in-turned lip portion 22 of body member 14.

Wear strip 42 is formed from a strip of material having a thickness dimension selected to provide the requisite strength and rigidity to the associated lip portion 22, which strength will permit handrail 10 to be assembled with handrail guide 28 by authorized trained personnel, but which will resist accidental, or intentional derailment from guide 28 by passengers on the associated transportation apparatus during use. For example, when wear strip is constructed of the hereinbefore mentioned polyurethane, a thickness dimension of about 1 to 3 mm is suitable.

While wear strip 42 must add strength and rigidity to the portion of handrail 10 which defines curved inner surface 34, it must not significantly affect the ability of handrail 10 to bend about a radius disposed perpendicular to the inner driving surface 38, as handrail 10 must be able to easily negotiate curved portions of the handrail guide 28 at the ends or turnarounds of the associated transportation apparatus. To enable wear strip 42 to resist forces which tend to open it up, i.e., to spread the leg portions 48 and 50 from their U-shaped, while enabling wear strip 42 to bend with the curvature of handrail 10 as it negotiates a handrail guide curve, at least the second leg portion 50 has a plurality of longitudinally spaced notches or slots 58. Slots 58 start at the longitudinally extending edge 54 and extend inwardly, preferably through the bight 46, terminating substantially at the start of the first leg portion 48.

Figure 3:
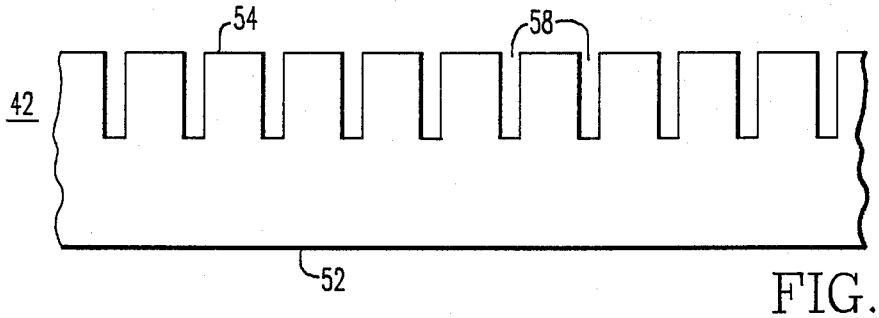
FIG. 3 is a plan view of a wear strip used in the FIG. 1 embodiment, illustrating the strip in a flattened configuration to more easily understand its construction.

Slots 58 in the embodiment of FIGS. 1 and 2 are disposed perpendicular to edge 54, with wear strip 42 being illustrated in an opened up or "flattened" configuration in FIG. 3 in order to more clearly illustrate the configuration of slots 58. It will be noted that slots 58, in this embodiment, are uniformly spaced along longitudinally extending edge 52, they are parallel with one another, and if the slots are about 1 mm wide, about the width of a band saw blade, a spacing of about 1.25 cm is adequate for a turnaround radius of about 35 cm. Of course, other slot widths and spacings may be used without departing from the teachings of the invention.

Figure 4:
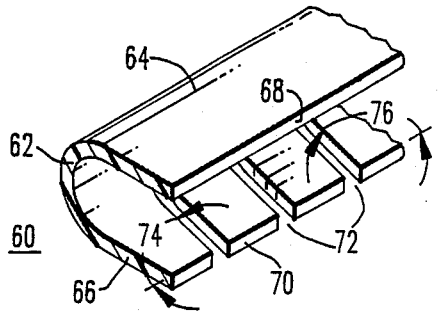
FIG. 4 is a perspective view of a wear strip constructed according to another embodiment of the invention in which spaced flexibility imparting sections are skewed instead of being perpendicular to an edge of the wear strip, as in the embodiment of FIGS. 1, 2 and 3.
Figure 5:
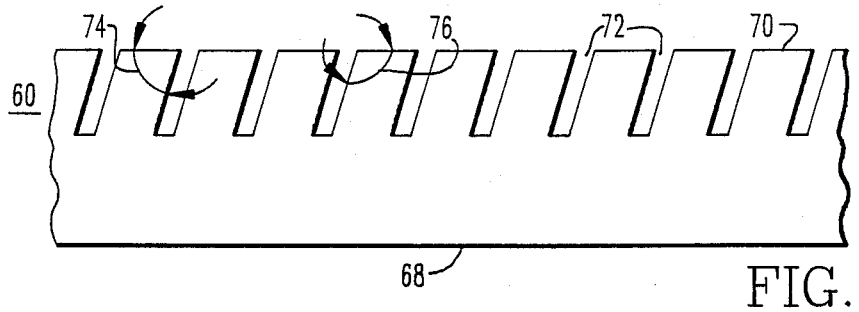
FIG. 5 illustrates the wear strip shown in FIG. 4, except in an unfolded or flattened configuration.

While the prependicular slot orientation of slots 58 in wear strips 42 and 44 is preferred because they are easy to make, other slot orientations may be satisfactorily used. For example, FIG. 4 is a perspective view of a wear strip 60 having a bight 62, first and second spaced leg portions 64 and 66, respectively, longitudinally extending edges 68 and 70 formd by the ends of leg portions 64 and 66, respectively, and a plurality of slots 72 which extend inwardly from edge 70 of the second leg portion 66. Slots 72, instead of being oriented normal with respect to the edge of the second leg portion 70, are skewed or angled such that each slot forms an acute angle 74 on one side of the slot and an obtuse angle 76 on the other side. FIG. 5 illustrates wear strip 60 in a flattened configuration, illustrating that slots 72 are uniformly spaced and parallel with one another.

Figure 6:
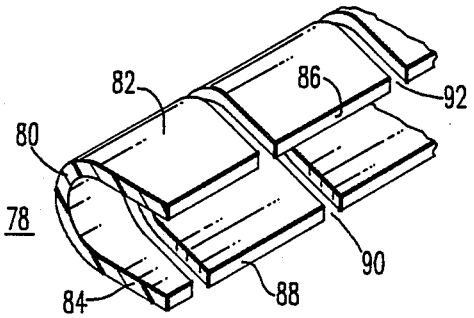
FIG. 6 is a perspective view of a wear strip constructed according to another embodiment of the invention in which the spaced flexibility imparting sections are provided in both leg portions of the wear strip.
Figure 7:
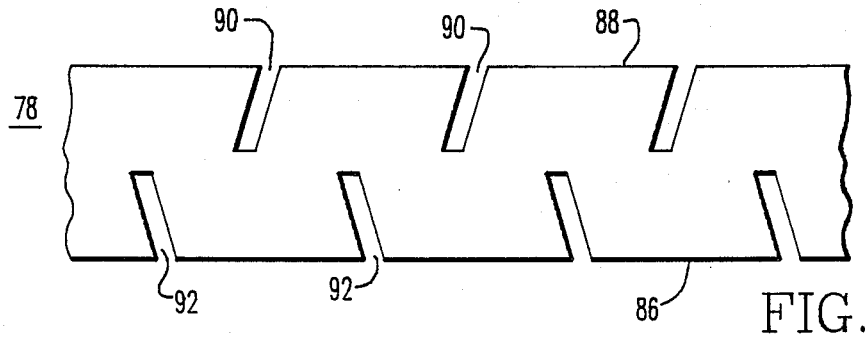
FIG. 7 illustrates the wear strip shown in FIG. 6, except in a flattened configuration.

FIG. 6 is a perspective view of a a wear strip 78, and FIG. 7 is a flattened view thereof, constructed according to another embodiment of the invention. Wear strip 78 includes a bight 80, first and second leg portions 82 and 84, respectively, and longitudinally extending edges 86 and 88 defined by the ends of leg portions 82 and 84, respectively. Instead of slots in only the second leg portion 84, as in the prior embodiments of the invention, slots 90 and 92 are provided in leg portions 88 and 86, respectively. Slots 90 and 92, which are interleaved with one another along the longitudinal dimension of wear strip 78, may extend perpendicularly inward from their respective edges 88 and 86 as in the FIG. 1 embodiment, or, as illustrated in FIGS. 6 and 7, they may be skewed as in the FIG. 4 embodiment.

Figure 8:
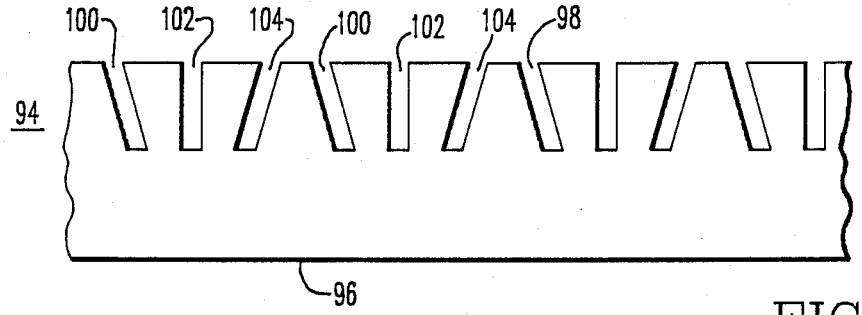
FIG. 8 illustrates a flattened configuration of still another wear strip construction which may be formed into a U-shaped cross-sectional configuration for use in the handrail shown in FIG. 1, with the spaced sections in this embodiment including a repeating pattern of non-parallel orientation.

While the embodiments discussed up to this point have had parallel slots, there is believed to be an advantage in having the slots non-parallel with one another. Non-parallel slots would tend to bridge any gaps in a substantially continuous handrail guiding system, reducing the possibility of wear strips catching on sharp edges of the guide system. Accordingly, FIG. 8 illustrates a flattened configuration of still another wear strip 94 which has first and second lateral edges 96 and 98, and a repeating pattern of differently oriented slots 100, 102 and 104 in at least the second lateral edge 98. Slots 100 and 104 are skewed in opposite directions to one another, while intervening slots 102 are normal to edge 98. Wear strip 94 may be formed into a U-shaped cross-sectional configuration and used in place of the wear strips 42 and 44 of the FIG. 1 embodiment.

Slots are the preferred method for providing flexibility in the wear strips in the desired location, because wear strips with slots are relatively easy to manufacture. Flexibility, however, may be added to relatively hard wear strips by other suitable arrangements. For example, instead of completely removing wear strip material to form slots, the thickness dimension of the wear strip material may be reduced in predetermined spaced sections of the wear strip, compared with the thickness dimension of the remaining portions of the strip. For example, the spaced sections may be in the same locations where slots are shown in the previously described embodiments.

Figure 9:
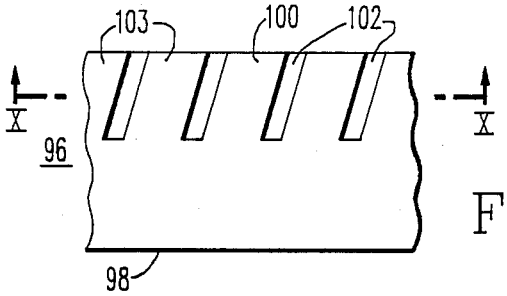
FIG. 9 is a veiw of a wear strip which is similar to the view shown in FIG. 5, except illustrating an embodiment of the invention in which the desired flexiblity is achieved by reducing the thickness of the material in the spaced sections, instead of removing the material to form open slots.
Figure 10:
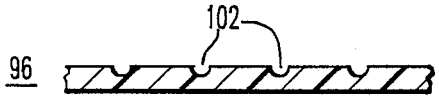
FIG. 10 is a cross sectional view of the wear strip shown in FIG. 9, taken between and in the direction of arrows X—X in FIG. 9.
Figure 10A:
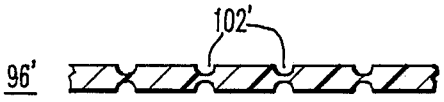
FIG. 10A is a cross sectional view of a wear strip which illustrates another embodiment of the wear strip shown in FIG. 9.

More specifically, FIG. 9 is an embodiment of the invention which is similar to the embodiment of FIG. 5, for example, except illustrating a wear strip 96 having first and second longitudinally extending edges 98 and 100, respectively. Instead of slots 72, as in the FIG. 5 embodiment, wear strip 96 has a plurality of spaced sections 102 which have a thickness dimension which is less than the thickness dimension of wear strip 96 in locations 103 disposed between the thin sections 102. Thin sections or webs 102 may be located where slots 72 are located. As shown in FIG. 10, which is a cross sectional view of wear strip 96, taken between and in the direction of arrows X—X in FIG. 9, webs 102 may be formed by reducing the thickness of the strip material from which the wear strip is formed, from one flat side thereof. FIG. 10A is similar to FIG. 10, except illustrating that webs 102' may be formed by reducing the thickness of the strip material from both of the major opposed flat sides. Webs have an advantage over slots, as the webs would impart flexibility while maintaining the integrity of the wear strip, prevention the wear strip from catching the handrail guide system in the vicinity of any gaps that may be incorporated therein for expansion and contraction purposes.

Figure 11:
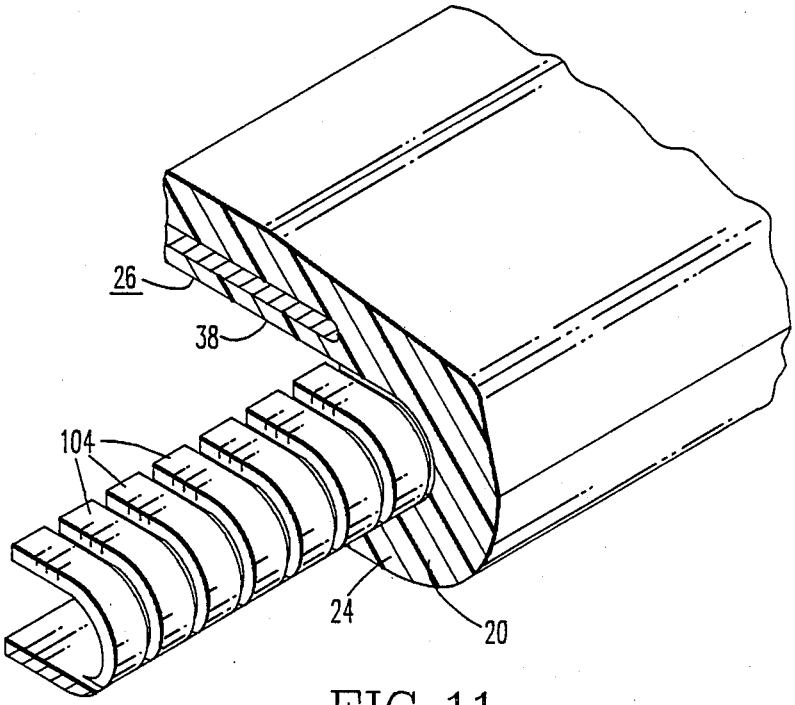
FIG. 11 is a fragmentary perspective view of an extruded handrail, similar to FIG. 1, except illustrating an embodiment of the invention in which the desired longitudinal flexibility is achieved by using a plurality of discrete, relatively short, closely spaced wear strips, with the spacing functioning as slots.

Instead of slots, or thin web-like sections, FIG. 11 illustrates an embodiment in which a plurality of discrete, spaced wear strips 104 are spaced apart to collectively define an elongated wear strip, with the spacing between the ends of the discrete wear strips functioning as slots to provide the requisite flexibility required for the handrail 10 to negotiate curved turnarounds in the handrail guide system.

In summary, there has been disclosed a new and improved extruded handrail in which the design criteria which normally require compromises, and thus less than optimum choices, are separated such that the handrail material may be selected for its flexibility and relatively high coefficient of friction with driving handrail rollers, without regard to the fact that the flexibility may promote easier derailment of the handrail from a handrail guide, and without regard to the fact that a higher coefficient of friction is normally undesirable because of drag and increased wear rates. For example, a polyurethane having a hardness of about 40 to 50 Shore A may be selected for the extruded body portion of the handrail 10. These mutually agreeable choices of flexibility and relative high coefficient of friction are made possible by placing first and second U-shaped wear strips in the curved inner portions of the handrail, i.e., at each lateral edge, which strips are constructed of a material selected for its strength and relatively low coefficient of sliding friction. The relatively high strength wear strips aid the handrail in resisting both accidental and deliberate efforts by passengers to derail the handrail from its guide, and the wear strips reduce drag on the handrail guide while providing a long wear life. The wear strips are constructed to facilitate flexing of the handrail as it proceeds about the curved turnarounds of an escalator or a moving walk, while limiting lip deflection, by spaced slots disposed in at least one of the leg portions of the U-shaped cross-sectional configuration of the wear strip.

We claim as our invention:

1. A handrail for an escalator or moving walk comprising:

an elongated, extruded elastomeric body member having a substantially C-shaped cross-sectional configuration which includes an inner surface which defines a handrail guide receiving configuration, said C-shaped cross-sectional configuration of said body member including a back portion and first and second depending legs which terminate in in-turned lip portions, said inner surface including first and second curved surfaces defined by said and second depending legs and in-turned lip portions, respectively, and a substantially flat drive surface which extends between said first and second curved inner surfaces, and first and second elongated wear strips disposed adjacent to said first and second curved inner surfaces, respectively, each of said first and second elongated wear strips having a bight, a first leg portion which terminates adjacent to said flat inner drive surface, and a second leg portion which extends approximately to the end of the associated lip portion, with said first and second leg portions defining first and second longitudinally extending edges of the associated wear strip, at least one of said leg portions of each of said first and second elongated wear strips having a plurality of spaced sections which extend inwardly from the associated longitudinally extending edge of the leg portion, with said spaced sections having a thickness dimension which is less than the thickness dimension of the wear strip between the spaced sections, wherein said first and second wear strips add rigidity to the lip portions which resist derailment of the elastomeric body member from a handrail guide, while the spaced thinner sections facilitate flexing of the elastomeric body member for traversing curved portions of a handrail guide.

2. The handrail of claim 1 wherein the spaced sections are disposed only in the second leg portion of each of the first and second elongated wear strips.

3. The handrail of claim 1 wherein the spaced sections are disposed in both the first and second leg portions of each of the first and second elongated wear strips.

4. The handrail of claim 1 wherein the spaced sections are disposed in the second leg portion of each of the first and second elongated wear strips, with said spaced sections being uniformly spaced and parallel with one another.

5. The handrail of claim 4 wherein the spaced sections are perpendicular to the associated longitudinally extending edge.

6. The handrail of claim 4 wherein the spaced sections define acute and obtuse angles on opposite sides of each section, at the intersection of each section and the associated longitudinally extending edge.

7. The handrail of claim 1 wherein the spaced sections are disposed in the second leg portion of each of the first and second elongated wear strips, with said spaced sections defining more than one angle with respect to the associated longitudinally extending edge.

8. The handrail of claim 1 wherein the spaced sections are disposed in both the first and second legs of the first and second elongated wear strips, alternating with one another such that a section associated with one longitudinally extending edge is adjacent to sections associated with the other longitudinally extending edge.

9. The handrail of claim 1 wherein the first and second wear strips are fixed to the first and second curved inner surfaces, respectively.

10. The handrail of claim 1 wherein the spaced sections are disposed in the second leg portion, extending inwardly from the longitudinally extending edge defined by the second leg portion, through the bight, to the start of the first leg portion.

11. The handrail of claim 1 wherein the spaced sections are slots.

12. The handrail of claim 1 wherein each of the first and second elongated wear strips are each collectively formed by a plurality of discrete, spaced wear strips, with the spacing being selected to function as the spaced sections.

13. The handrail of claim 1 wherein the handrail includes first and second extruded pockets, each defining first and second shoulders which aid in locating and holding the positions of the first and second elongated wear strips.

* * * * *